US012016428B2

(12) United States Patent
Plessas et al.

(10) Patent No.: US 12,016,428 B2
(45) Date of Patent: Jun. 25, 2024

(54) ADJUSTABLE INSOLE FOR A FOOTWEAR ARTICLE

(71) Applicant: Honeywell International Inc., Charlotte, NC (US)

(72) Inventors: Dimitris Plessas, Brno (CZ); Juraj Suska, Brno (CZ); Maria Rojko Nisu, Brno (CZ)

(73) Assignee: Honeywell International Inc., Charlotte, NC (US)

( * ) Notice: Subject to any disclaimer, the term of this patent is extended or adjusted under 35 U.S.C. 154(b) by 62 days.

(21) Appl. No.: 17/812,972

(22) Filed: Jul. 15, 2022

(65) Prior Publication Data

US 2024/0016257 A1 Jan. 18, 2024

(51) Int. Cl.

| | |
|---|---|
| ***A43B 17/16*** | (2006.01) |
| ***A43B 7/144*** | (2022.01) |
| ***A43B 7/1485*** | (2022.01) |
| ***A43B 17/18*** | (2006.01) |
| ***A43B 21/42*** | (2006.01) |

(52) U.S. Cl.
CPC ..... *A43B 17/16* (2013.01); *A43B 7/144* (2013.01); *A43B 7/1485* (2013.01); *A43B 17/18* (2013.01); *A43B 21/42* (2013.01)

(58) Field of Classification Search
CPC ..... A43B 7/144; A43B 7/1485; A43B 21/42; A43B 17/16; A43B 17/18
See application file for complete search history.

(56) References Cited

U.S. PATENT DOCUMENTS 7,950,167 B2 5/2011 Nakano
2008/0289219 A1* 11/2008 Nakano ..... A43B 13/186 36/43

FOREIGN PATENT DOCUMENTS

KR 2011-0034878 A 4/2011

OTHER PUBLICATIONS

Extended European Search Report dated Nov. 7, 2023 for EP Application No. 23181416, 7 page(s).

* cited by examiner

*Primary Examiner* — Khoa D Huynh
*Assistant Examiner* — Erick I Lopez
(74) *Attorney, Agent, or Firm* — Alston & Bird LLP

(57) ABSTRACT

Various embodiments are directed to an adjustable insole for a footwear article. In various embodiments, the adjustable insole comprises an insole body comprising a heel bottom cavity defined by a cavity opening provided along an insole body bottom surface; and a removeable heel bottom insert configured to be disposed within the heel bottom cavity such that a first insert portion is disposed within the heel bottom cavity and a second insert portion defines a lowermost surface of the adjustable insole, the removeable heel bottom insert having a selectively adjustable configuration relative to the insole body that is defined by an arrangement of the removeable heel bottom insert within the heel bottom cavity in one of a nominal position and a rotated position defined relative to the nominal position by a rotation of the removeable heel bottom insert through an angle of rotation of at least approximately 90 degrees.

19 Claims, 10 Drawing Sheets

ADJUSTABLE INSOLE FOR A FOOTWEAR ARTICLE

FIELD OF THE INVENTION

Various embodiments described herein relate generally to footwear. In particular, various embodiments are directed to insoles for footwear articles.

BACKGROUND

Various applications may require the use of one or more footwear articles configured to be worn on the feet of a user. In particular, a removeable insole may be inserted into a footwear article and designed to facilitate user comfort and support while wearing the footwear article. Through applied effort, ingenuity, and innovation, Applicant has solved problems relating to footwear articles by developing solutions embodied in the present disclosure, which are described in detail below.

BRIEF SUMMARY

Various embodiments are directed to an adjustable insole for a footwear article and method of using the same. In various embodiments, an adjustable insole for a footwear article may comprise an insole body configured to be removably inserted into a footwear article, the insole body comprising a heel bottom cavity defined by a cavity opening provided along an insole body bottom surface of the insole body, the heel bottom cavity being defined within a heel body portion of the insole body; and a removeable heel bottom insert configured to be at least partially disposed within the heel bottom cavity such that a first insert portion is disposed within the heel bottom cavity and a second insert portion defines at least a portion of a lowermost surface of the adjustable insole, the removeable heel bottom insert having a selectively adjustable configuration relative to the insole body that is defined by an arrangement of the removeable heel bottom insert within the heel bottom cavity in one of a nominal position and a rotated position; wherein the rotated position of the removeable heel bottom insert within the heel bottom cavity is defined relative to the nominal position by a rotation of the removeable heel bottom insert within the heel bottom cavity through an angle of rotation of at least approximately 90 degrees; and wherein the arrangement of the removeable heel bottom insert within the heel bottom cavity in one of the nominal position and the rotated position corresponds to a selective adjustment of the adjustable insole between a nominal configuration and a cushioned configuration, the selective adjustment of the adjustable insole between the nominal configuration and the cushioned configuration defining an adjustment of one or more structural support characteristics defined by the adjustable insole.

In various embodiments, the removeable heel bottom insert may comprise an insert bottom plate and an insert interface component configured to engage one or more surfaces defined within the heel bottom cavity, the first insert portion of the removeable heel bottom insert being defined by the insert interface component and the second insert portion of the removeable heel bottom insert being defined by the insert bottom plate bottom. In certain embodiments, the second insert portion may be defined by a bottom plate surface of the insert bottom plate, the bottom plate surface being configured for contacting an interior surface of the footwear article, and wherein the insert interface component is configured to extend from a top plate surface of the insert bottom plate, the top plate surface facing in an at least substantially opposite direction relative to the bottom plate surface.

In various embodiments, the insert interface component may comprise a variable thickness defined between the insert bottom plate and an insert interface surface, the insert interface component being configured to engage the one or more surfaces within the heel bottom cavity at the insert interface surface. In certain embodiments, the insert interface surface may be defined by an at least substantially non-planar surface, the insert interface component being defined by one or more geometric features protruding from the insert bottom plate to the insert interface surface such that the one or more geometric features of the insert interface component are configured to engage the one or more surfaces within the heel bottom cavity at the at least substantially non-planar surface. In certain embodiments, the insole body may comprise a cavity interface component defined with the heel bottom cavity, the cavity interface component being configured for contact with at least a portion of the insert interface surface contact to at least partially define the arrangement of the insert interface component within the heel bottom cavity, the one or more surfaces within the heel bottom cavity configured to be engaged by the insert interface component being defined by the cavity interface component. Further, in certain embodiments, the insert interface surface may comprise an at least partially wave-shaped configuration, and wherein the one or more geometric features comprises a plurality of interface grooves distributed laterally along a width of the removeable heel bottom insert, each of the plurality of interface grooves extending along a respective groove length defined between opposing longitudinal ends of the removeable heel bottom insert.

In certain embodiments, the removeable heel bottom insert may be configured such that, upon the removeable heel bottom insert being at least partially disposed within the heel bottom cavity, the one or more geometric features defining the insert interface component comprises a symmetric configuration over a central longitudinal axis defined by the insole body. In various embodiments, the insert interface component may be configured to engage a cavity interface component disposed within the heel bottom cavity, the cavity interface component comprising a cavity interface surface configured to physically contact the insert interface surface, wherein the cavity interface surface is defined by a configuration that corresponds at least in part to the configuration of the insert interface surface.

In various embodiments, the removeable heel bottom insert may be defined at least in part by an insert interface surface having a first surface configuration, the first surface configuration corresponding at least in part to a second surface configuration of a cavity interface surface defined within the heel bottom cavity. In certain embodiments, the nominal position of the removeable heel bottom insert may be defined by at least substantially all of the removeable heel bottom insert being disposed within the heel bottom cavity such that at least substantially all of a cavity volume defined within the heel bottom cavity is occupied by one of the removeable heel bottom insert and a cavity interface component engaged therewith. In certain embodiments, the nominal position may be defined by the second portion of the removeable heel bottom insert being defined by a bottom plate surface of an insert bottom plate of the removeable heel bottom insert, the bottom plate surface being arranged in an at least substantially aligned configuration relative to one or more adjacent portions of the insole body bottom surface.

In various embodiments, the heel bottom cavity may be arranged within the heel body portion such that a first lateral side of a cavity perimeter of the heel bottom cavity is separated from an inner lateral side of the insole body bottom surface by a first lateral separation gap defined along the insole body bottom surface; wherein a second lateral side of the cavity perimeter of the heel bottom cavity is separated from an outer lateral side of the insole body bottom surface by a second lateral separation gap defined along the insole body bottom surface. In certain embodiments, the heel bottom cavity may be arranged within the heel body portion such that a rear side of the cavity perimeter of the heel bottom cavity is separated from a rear portion of the insole body bottom surface by a first longitudinal separation gap defined along the insole body bottom surface.

In various embodiments, the heel bottom cavity may be centered along a central longitudinal axis of the insole body, wherein a cavity interface component disposed within the heel bottom cavity and defined by one or more geometric features configured to engage the removeable heel bottom insert, and wherein the cavity interface component is configured such that the one or more geometric features defines an at least substantially symmetric configuration over the central longitudinal axis. In various embodiments, the selective adjustment of the adjustable insole between the nominal configuration and the cushioned configuration may correspond to an adjustment of one or more structural support characteristics defined within the heel body portion of the insole body. In various embodiments, the rotated position of an exemplary removeable heel bottom insert may be defined relative to the nominal position of the removeable heel bottom insert by an at least substantially 90 degree turn about a central axis thereof such that a first length of an insert interface component defined by the removeable heel bottom insert is provided in an at least substantially perpendicular direction relative to a second length of a cavity interface component defined within the heel bottom cavity.

In various embodiments, the removeable heel bottom insert may comprise an insert interface component defined by one or more insert interface grooves, wherein the heel bottom cavity includes a cavity interface component disposed therein that is defined by a plurality of cavity interface grooves, the plurality of insert interface grooves being configured to physically contact at least a portion of the plurality of cavity interface grooves upon the removeable heel bottom insert being disposed within the heel bottom cavity, and wherein the rotated position of the removeable heel bottom insert is defined by the removeable heel bottom insert being positioned within the heel bottom cavity such that the plurality of insert interface grooves extend along respective lengths that are defined in a first direction that is at least substantially transverse to a second direction in which lengths of each of the cavity interface grooves of the cavity interface component extend.

In various embodiments, the rotated position of the removeable heel bottom insert may be defined the removeable heel bottom insert and a cavity interface component engaged therewith within the heel bottom cavity collectively defining an increased collective height such that the heel body portion defines an at least partially raised configuration relative to a second configuration wherein the removeable heel bottom insert is in the nominal position. In various embodiments, the rotated position of the removeable heel bottom insert may be defined by an insert interface component of the removeable heel bottom insert engaging at least a portion of a cavity interface component disposed within the heel bottom cavity such that at least one air channels defined by unoccupied cavity volume within the heel bottom cavity are defined between the removeable heel bottom insert and the cavity interface component.

BRIEF DESCRIPTION OF THE DRAWINGS

Reference will now be made to the accompanying drawings, which are not necessarily drawn to scale, and wherein.

DETAILED DESCRIPTION

Figure 1A:
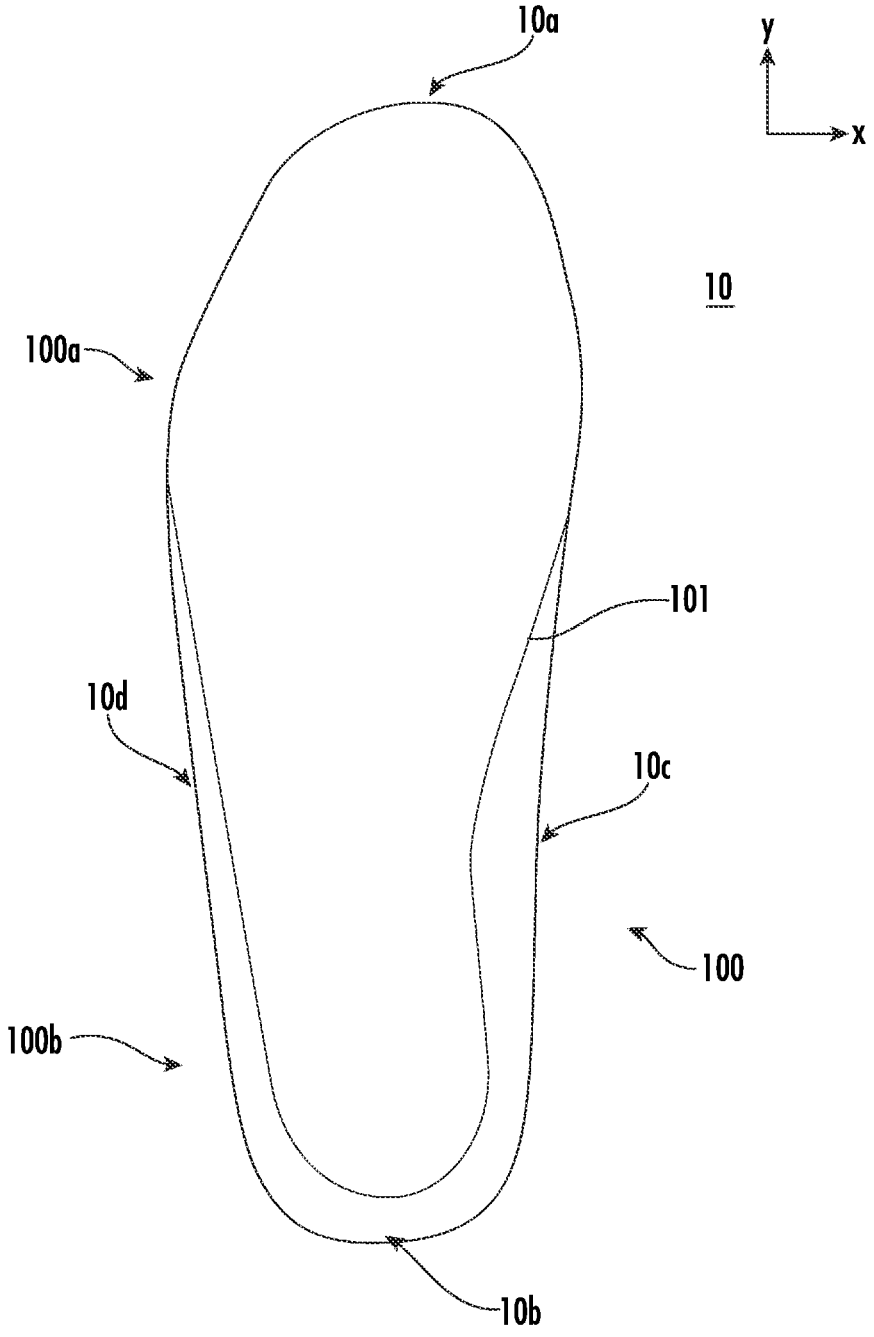
FIGS. 1A and 1B illustrate various views of an exemplary adjustable insole according to one or more embodiments described herein.

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

It should be understood at the outset that although illustrative implementations of one or more aspects are illustrated below, the disclosed assemblies, systems, and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents. While values for dimensions of various elements are disclosed, the drawings may not be to scale.

The words "example," or "exemplary," when used herein, are intended to mean "serving as an example, instance, or illustration." Any implementation described herein as an "example" or "exemplary embodiment" is not necessarily preferred or advantageous over other implementations. The use of directional terms should not be interpreted to limit the invention to any specific orientation. Further, as used herein, the term "arch region" (or arch or midfoot) refers generally to a portion of a footwear article and/or a wearer's foot corresponding to the arch or midfoot of the wearer's foot; the term "forefoot region" (or forefoot) refers generally to a portion of a footwear article and/or a wearer's foot forward of the arch region corresponding to the forefoot (for example, including the ball and the toes) of a wearer's foot; and the term "heel region" (or heel) refers generally to that portion a footwear article and/or a wearer's foot rearward of the arch region corresponding to the heel of the wearer's foot.

The present invention relates to an adjustable insole for a footwear article that comprises an insole body comprising a heel bottom cavity defined by a cavity opening that is provided along a portion of an insole body bottom surface defined within a heel body portion of the insole body. In various embodiments, the adjustable insole includes a removeable heel bottom insert configured to be at least partially disposed within the heel bottom cavity such that at least a portion of an insert interface component of the removeable heel bottom insert is disposed within the heel bottom cavity and a bottom plate surface of an insert bottom plate connected to the insert interface component defines at least a portion of a lowermost surface of the adjustable insole. As described herein, the removeable heel bottom insert has a selectively adjustable configuration relative to the insole body in which one or more structural support characteristics and/or cushioning properties defined by the adjustable insole (e.g., within the heel body portion) may be adjusted based on an arrangement of the removeable heel bottom insert within the heel bottom cavity in either a nominal position or a rotated position.

The adjustable insert described herein may be configured such the removeable heel bottom insert may be selectively rearranged from a nominal position to a rotated position within the heel bottom cavity by rotating the removeable heel bottom insert within the heel bottom cavity through an angle of rotation of at least approximately 90 degrees. Further, as described herein, the arrangement of the removeable heel bottom insert within the heel bottom cavity in either the nominal position or the rotated position corresponds to a selective adjustment of the adjustable insole between a nominal configuration and a cushioned configuration. For example, the selective adjustment of the adjustable insole between the nominal configuration and the cushioned configuration may be defined an adjustment of one or more structural support characteristics and/or cushioning properties defined by the adjustable insole. The present invention provides an insole for a footwear article that has an adjustable configuration defined by the selective arrangement of one or more interface grooves defined by an insert interface component of the removeable heel bottom insert being arranged in a transverse direction relative to a corresponding one or more interface grooves defined by a cavity interface component provided within the heel bottom cavity of the insole body. In such an exemplary configuration, resulting from the arrangement of the removeable heel bottom insert in the rotated position, one or more air channels are defined within the heel bottom cavity in between the removeable heel bottom insert and the cavity interface component within the heel bottom cavity. The air channels defined between the cavity interface component and the removeable heel bottom insert may corresponding to additional cushioning properties, enhanced rebound properties, and improved shock absorption capabilities within the heel body portion of the adjustable insole. As described herein, the present invention defines a singular insole body having an at least substantially simplified means of adjustment, as described herein, so as to maximize ease of use and user comfort during operation, while minimizing the manufacturing and product costs associated with providing an effective means of structural support adjustability, as described herein.

Figure 1B:
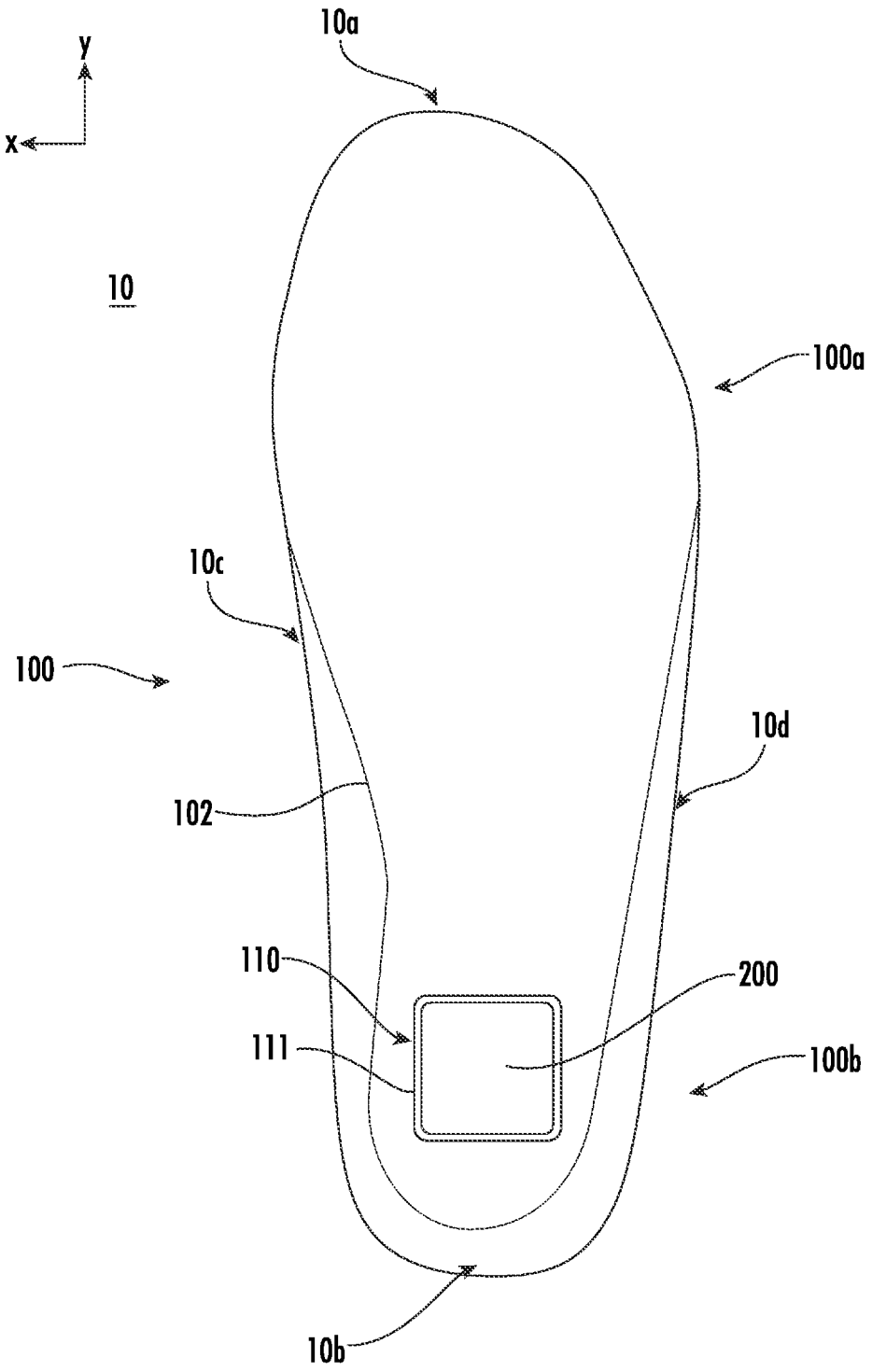

FIGS. 1A and 1B illustrate various views of an exemplary adjustable insole according to one or more embodiments described herein. In particular, FIG. 1A illustrates of an exemplary adjustable insole 10. As illustrated in various embodiments, an exemplary adjustable insole 10 may comprise an insole body 100 configured for insertion into an interior portion of a footwear article such that, upon a user inserting a foot into the interior portion of the footwear article, the insole 10 is engaged with the bottom of the user's foot to facilitate increased comfort and/or support for the user wearing the footwear article. An exemplary adjustable insole 10 may comprise an insole body 100 having an insole body top surface 101 that is configured for receiving the foot of a user within the interior portion of the footwear article. For example, the insole body 100 may comprise a forefoot body portion 100*a* that, upon the exemplary insole 10 being disposed within a footwear article, may be provided in a forefoot region of a footwear article such that the forefoot body portion 100*a* is configured for supporting the forefoot portion of a user's foot. As illustrated, a front end 10*a* of the adjustable insole 10 may be defined by the forefoot body portion 100*a* of the insole body 100. Further, the insole body 100 may comprise a heel body portion 100*b* that, upon the exemplary insole 10 being disposed within a footwear article, may be provided in a heel region of a footwear article such that the heel body portion 100*b* is configured for supporting the heel portion of a user's foot. As illustrated, a rear end 10*b* of the adjustable insole 10 may be defined by the heel body portion 100*b* of the insole body 100. Further, in various embodiments, a width of an exemplary adjustable insole 10 may be defined between opposing lateral sides of the insole body 100, such as, for example, between an inner lateral side 10*c* of the insole 10 and an outer lateral side 10*d* of the insole 10.

As illustrated in FIG. 1B, the insole body 100 of an exemplary adjustable insole 10 may be further defined by an insole body bottom surface 102 that is configured for contacting an inner surface within the interior portion of the footwear article so as to establish and interface between the adjustable insert 10 and the footwear article. Further, in various embodiments, the insole body 100 of an exemplary adjustable insole 10 may comprise a heel bottom cavity 110 positioned along the insole body bottom surface 102 of the insole body 100. As described herein, a heel bottom cavity 110 may be configured for receiving a removeable heel bottom insert therein to facilitate the adjustable configuration of the adjustable insole 10. For example, the heel bottom cavity 110 may comprise a cavity opening through which the heel bottom cavity 110 may receive a removeable heel bottom insert. As illustrated, the cavity opening 112 may be defined by a cavity perimeter 111 that extends along the insole body bottom surface 102 of the insole body 100 such that the cavity opening 112 is defined within the insole body bottom surface 102 of the insole body 100.

As illustrated, in various embodiments, the exemplary adjustable insole 10 may comprise a removeable heel bottom insert 200 that is configured to be disposed within the heel bottom cavity 200 in one of a plurality of configurations to facilitate the adjustable configuration of the exemplary insole. As described herein, the adjustable insole 10 may be configured such that removeable heel bottom insert 200 may be received within the heel bottom cavity 110 (e.g., via the cavity opening defined by the cavity perimeter 111) such that at least a portion of a lowermost surface of the adjustable insole 10 (e.g., an insole body bottom 100) is defined by a bottom insert plate of the removeable heel bottom insert 200.

Figure 2:
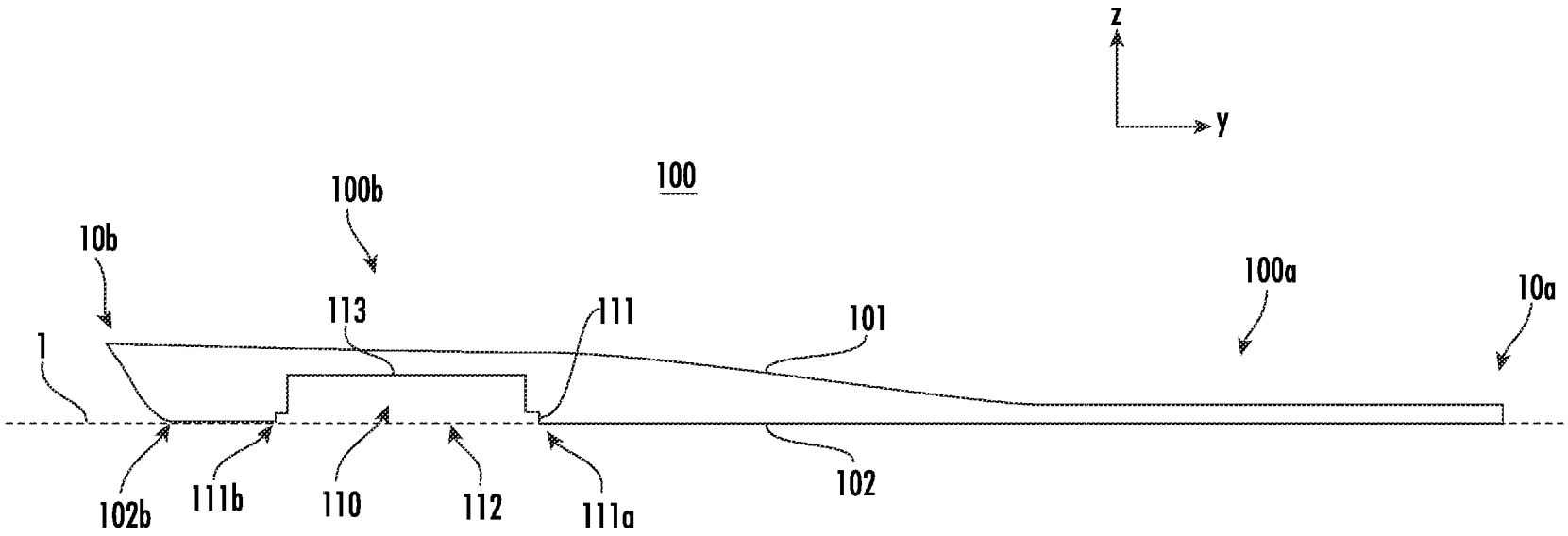
FIG. 2 illustrates a side cross-sectional view of an exemplary insole body, according to various embodiments described herein.

For example, as illustrated in FIG. 2, an exemplary adjustable insole 10 may comprise an insole body 100 with a heel bottom cavity 110 having a cavity opening 112 defined along the insole body bottom surface 102 such that the heel bottom cavity is arranged within a heel body portion 100*b* of the insole body 100. In various embodiments, the heel bottom cavity 110 may embody a material recess that is defined relative to the insole body bottom surface 102 and has a configuration that corresponds at least in part to that of the removeable heel bottom insert, as described herein. For example, the heel bottom cavity 110 may be defined by a recessed cavity surface 113 that has a recessed configuration relative to the insole body bottom surface 102. The recessed cavity surface 113 may be positioned within the thickness of the insole body 100 between the insole body top surface 101 and the insole body bottom surface 102 such that the depth of the heel bottom cavity 110 is defined at least in part by the arrangement of the recessed cavity surface 113 relative to the cavity opening 112. In various embodiments, the heel bottom cavity 110 may be defined by a separation between the recessed cavity surface 113 and the portion of the insole body bottom surface 102 defining the cavity perimeter 111, wherein the separation is defined in a vertical direction (e.g., in a z-direction as defined in the exemplary orientation illustrated in FIG. 2). For example, the heel bottom cavity 110 may be configured such that, upon a removeable heel bottom insert being received within the heel bottom cavity 110 and engaged by one or more surfaces within the heel bottom cavity 110 (e.g., an insert interface), at least a portion of the removeable heel bottom insert may be disposed within the cavity opening 112 in between a front side and a rear side 111*b* of the cavity perimeter 111.

Figure 3:
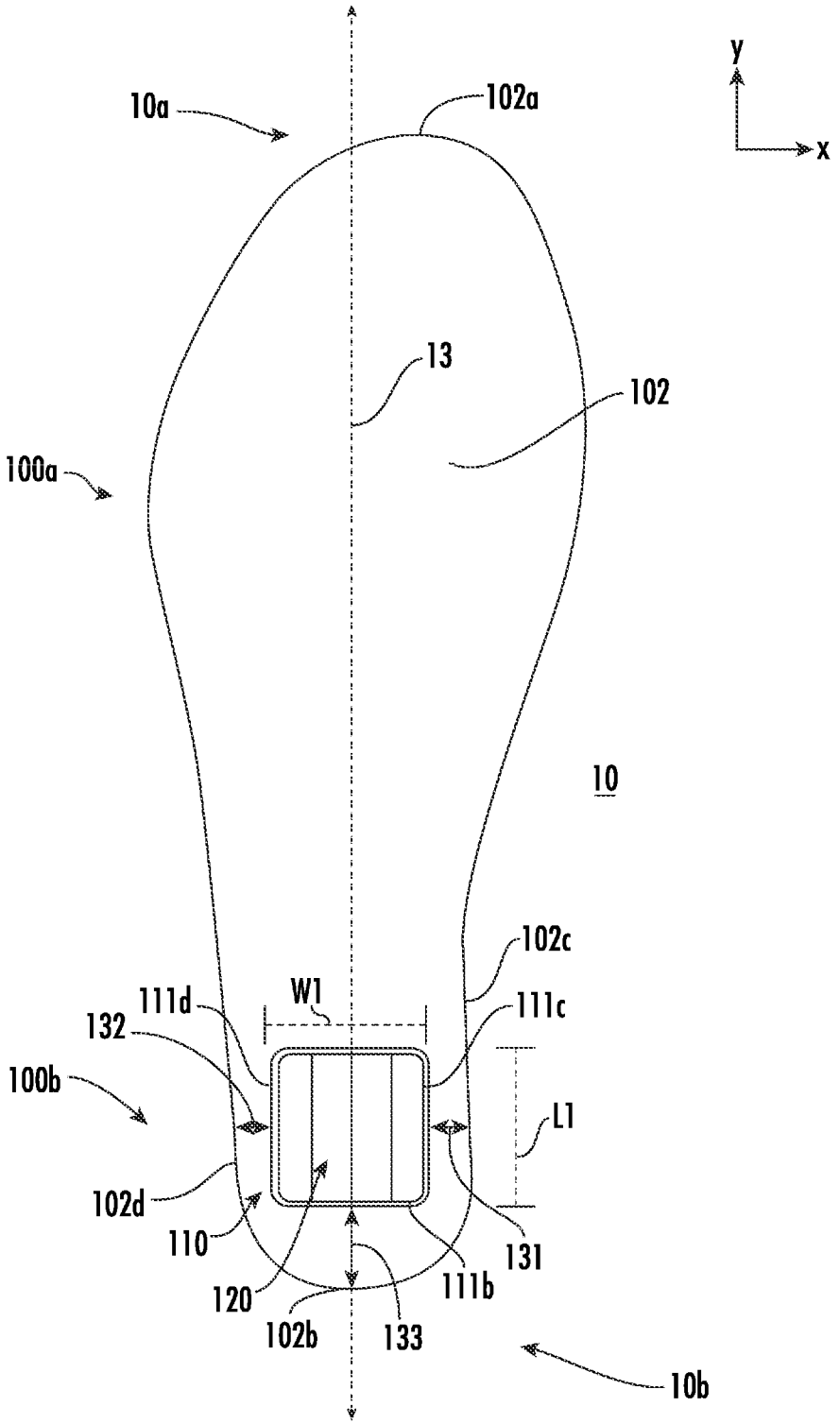
FIG. 3 schematically illustrates a bottom view of an exemplary insole body according to various embodiments described herein.

In various embodiments, the heel bottom cavity 110 may arranged about a heel body portion 110*b* of an exemplary insole body 100 such that a removeable heel bottom insert disposed therein may be configured to provide support for a heel portion of a user's foot while the foot is engaged with the insole body top surface 101 of the insole body 100. For example, FIG. 3 schematically illustrates a bottom view of an exemplary insole body according to various embodiments described herein. As illustrated, the heel bottom cavity 110 may be arranged within a heel body portion 100*b* of the insole body 100 such that the cavity opening 112 is defined at an at least substantially central position within the portion of the insole body bottom surface 102 defined within the heel body portion 100*b*. For example, as illustrated, the heel bottom cavity 110 may be arranged within the heel body portion 100*b* such that a first lateral side 111*c* of the cavity perimeter 111 having a length extending along the insole body bottom surface 102 in an at least substantially longitudinal direction (e.g., in the y-direction as defined according to the exemplary embodiment illustrated in FIG. 3) is separated from an inner lateral side 102*c* of the insole body bottom surface 102 by a first lateral separation gap 131. The first lateral separation gap 131 may be defined at least in part by a lateral distance between at least a portion of the first lateral side 111*c* of the cavity perimeter 111 and the inner lateral side 102*c* of the insole body bottom surface 102. As a non-limiting, illustrative example, in various embodiments, the first lateral separation gap 131 may be at least approximately between 4.0 mm and 12.0 mm (e.g., between 6.0 mm and 10.0 mm).

Further, as illustrated, the heel bottom cavity 110 may be arranged within the heel body portion 100*b* such that a second lateral side 111*d* of the cavity perimeter 111 having a length extending along the insole body bottom surface 102 in an at least substantially longitudinal direction (e.g., in the y-direction as defined according to the exemplary embodiment illustrated in FIG. 3) is separated from an outer lateral side 102*d* of the insole body bottom surface 102 by a second lateral separation gap 132. The second lateral separation gap 132 may be defined at least in part by a lateral distance between at least a portion of the second lateral side 111*d* of the cavity perimeter 111 and the outer lateral side 102*d* of the insole body bottom surface 102. As a non-limiting, illustrative example, in various embodiments, the second lateral separation gap 132 may be at least approximately between 4.0 mm and 12.0 mm (e.g., between 6.0 mm and 10.0 mm). For example, in various embodiments, the heel bottom cavity 110 may be configured such that the first and second lateral sides 111*c*, 111*d* of the cavity perimeter 111 may extend along the insole body bottom surface 102 in an at least substantially parallel longitudinal directions.

Further, as illustrated, the heel bottom cavity 110 may be arranged within the heel body portion 100*b* such that a rear side 111*b* of the cavity perimeter 111 having a length extending along the insole body bottom surface 102 in an at least substantially lateral direction (e.g., in the x-direction as defined according to the exemplary embodiment illustrated in FIG. 3) between the first and second lateral sides 111*c*, 111*d* is separated from the rear bottom surface end 102*b* of the insole body bottom surface 102 by a longitudinal separation gap 133. The longitudinal separation gap 133 may be defined at least in part by a longitudinal distance between at least a portion of the rear side 111*b* of the cavity perimeter 111 and the rear bottom surface end 102*b* of the insole body bottom surface 102. As a non-limiting, illustrative example, in various embodiments, the longitudinal separation gap 133 may be at least approximately between 15.0 mm and 25.0 mm (e.g., between 18.0 mm and 22.0 mm).

For example, in various embodiments, the heel bottom cavity 110 may be configured such that the rear side 111*b* of the cavity perimeter 111 extends along the insole body bottom surface 102 in an at least substantially perpendicular direction relative to the first and second lateral sides 111*c*, 111*d*. For example, in various embodiments, the front and rear sides 111*b* and the first and second lateral sides 111*c*, 111*d* of the cavity perimeter 111 may arranged such that the cavity perimeter 111 comprises an at least substantially square configuration defined at least in part by a cavity width W1 corresponding to the length of the front side and/or the rear side 111*b* of the cavity perimeter 111 (e.g., in the x-direction as defined in the exemplary orientation illustrated in FIG. 3), and a cavity length L1 corresponding to the length of the first lateral side 111*c* and/or the second lateral side 111*d* of the cavity perimeter 111 (e.g., in the y-direction as defined in the exemplary orientation illustrated in FIG. 3). As a non-limiting, illustrative example, in various embodiments, the cavity width W1 of the heel bottom cavity 110 may be at least approximately between 35.0 mm and 55.0 mm (e.g., between 42.0 mm and 48.0 mm). Further, a s a non-limiting, illustrative example, in various embodiments, the cavity length L1 of the heel bottom cavity 110 may be at least approximately between 35.0 mm and 55.0 mm (e.g., between 42.0 mm and 48.0 mm).

In various embodiments, the heel bottom cavity 110 defined by the insole body 100 of an exemplary adjustable insole 10 may be defined by a cavity interface component 120 disposed within the heel bottom cavity 110 and configured for receiving and/or engaging the removeable heel bottom insert (e.g., in either a nominal position or a rotated position, as described herein) to facilitate the configuration of the adjustable insole 10 in either a nominal configuration or a cushioned configuration. In various embodiments, the cavity interface component 120 may be defined by a material thickness extending from a recessed cavity surface of the heel bottom cavity 110 to an at least substantially non-planar cavity interface surface positioned within the heel bottom cavity 110 that is configured for engagement with at least a portion of a removeable heel bottom insert positioned within the heel bottom cavity 110. As illustrated, the cavity interface surface of the cavity interface component 120 may have an at least substantially non-planar configuration such that the cavity interface component 120 is defined by a variable thickness. For example, in various embodiments, the cavity interface component 120 may be defined by one or more protruding geometric features such as, for example, a plurality of interface grooves having respective lengths that extend along the length of the recessed cavity surface, such as, for example, in a longitudinal direction defined between a front side and a rear side 111*b* of the cavity perimeter 111 of the heel bottom cavity 110 (e.g., in the y-direction, as defined in the exemplary orientation illustrated in FIG. 3). Further, in various embodiments, the plurality of interface grooves defined by the cavity interface component 120 may be distributed along a width of the recessed cavity surface (e.g., in the x-direction, as defined in the exemplary orientation illustrated in FIG. 3). For example, as described herein, the plurality of interface grooves defined by the cavity interface component 120 disposed within the heel bottom cavity 110 may include an at least partially wave-shaped cavity interface surface that corresponds to the wave-shaped configuration of the insert interface surface defined by an insert interface component of the removeable heel bottom insert to facilitate a robust engagement therebetween upon the removeable heel bottom insert being inserted into the heel bottom cavity 110 (e.g., in the nominal position).

In various embodiments, an exemplary adjustable insole 10 may define a central longitudinal axis 13 that extends along a length of the insole 10 in a longitudinal direction (e.g., in a y-direction, as defined by the exemplary orientation illustrated in FIG. 3) between a rear end 10*b* of the insole 10 defined by the heel body portion 100*b* and a front end 10*a* defined by the forefoot body portion 100*a*. In various embodiments, an exemplary heel bottom cavity 110 of the insole body 100 may be positioned along the insole body bottom surface 102 so as to be centered (e.g., laterally) on the central longitudinal axis 13 of the adjustable insole 10. For example, as illustrated, the heel bottom cavity 110 may be centered along the central longitudinal axis 13 such that the cavity interface component 120 defined by the insole body 100 within the heel bottom cavity 110 defines an at least substantially symmetric configuration over the central longitudinal axis 13. As described herein, an exemplary adjustable insole 10 may be configured such that the cavity interface component 120 (e.g., the interface grooves defined by the cavity interface surface thereof) and/or the removeable heel bottom insert configured to be disposed within the heel bottom cavity 110 (e.g., in either a nominal position or a rotated position) may be symmetrical over the central longitudinal axis 13 to facilitate an even distribution of forces (e.g., support forces) throughout the heel body portion 100*b* of the insole body 100 in order to maximize the stability of a user's foot relative to the adjustable insole 10.

Figure 4A:
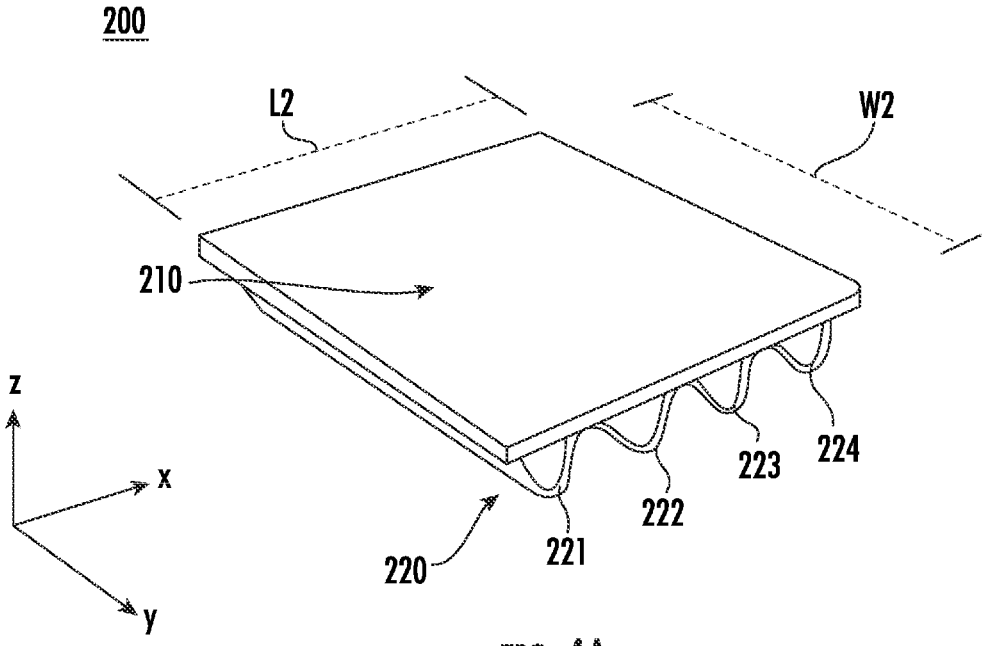
FIGS. 4A and 4B illustrate various perspective views of an exemplary removeable heel bottom insert according to various embodiments described herein.
Figure 4B:
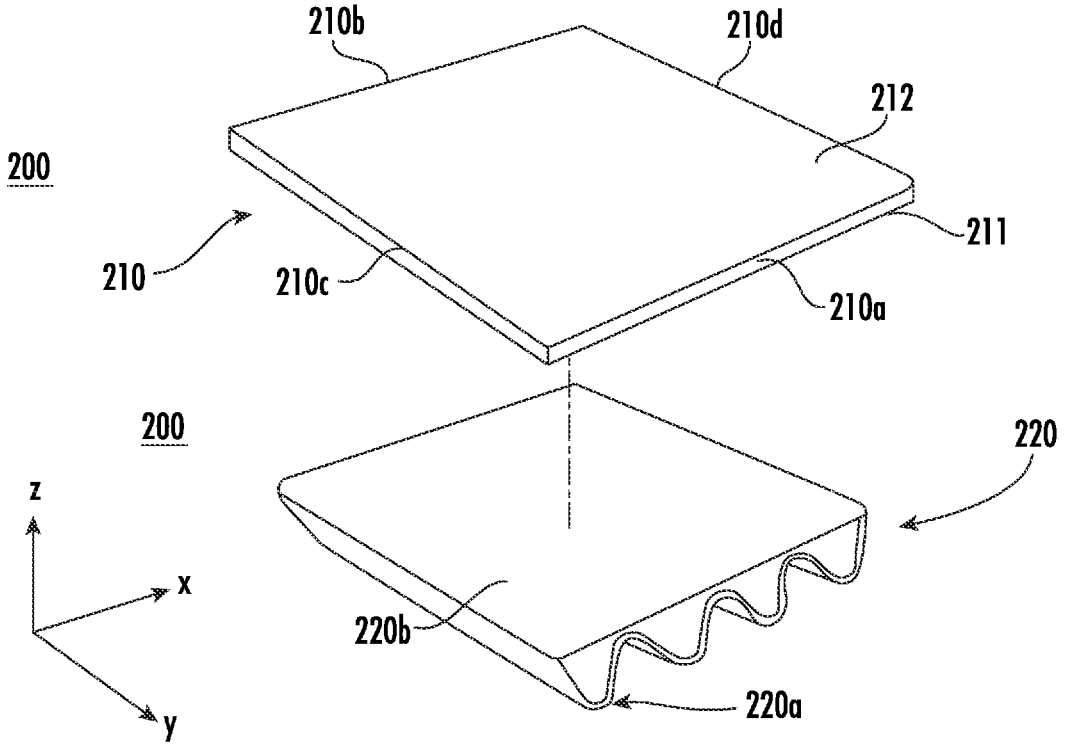

FIGS. 4A and 4B illustrate various perspective views of an exemplary removeable heel bottom insert according to various embodiments described herein. In particular, FIGS. 4A and 4B illustrate a perspective view and an exploded view, respectively of an exemplary removeable heel bottom insert 200 of an adjustable insole. In various embodiments, an exemplary removeable heel bottom insert 200 may comprise an insert bottom plate 210 configured for contacting an interior surface of a footwear article and an insert interface component 220 configured to engage one or more surfaces within the insole body cavity so as to define the configuration of an exemplary adjustable insole in either a nominal configuration or a cushioned configuration. In various embodiments, the removeable heel bottom insert 200 may be configured to be at least partially inserted into the heel bottom cavity of the insole body until the insert interface component 220 (e.g., the insert interface surface 220*a*) engages a corresponding cavity interface component defined along the recessed cavity surface of the heel bottom cavity. For example, the removeable heel bottom insert 200 may be configured such that, upon being inserted in the heel bottom cavity of the insole body, the insert interface component 220 (e.g., in either a nominal position or a rotated position, as described herein) is disposed in between the insert bottom plate 210 and the recessed cavity surface of the bottom heel cavity. In various embodiments, upon the insert interface component 220 engaging one or more surfaces within the heel bottom cavity of the insole body, such as, for example, a corresponding cavity interface surface disposed within the heel bottom cavity, the insert bottom plate 210 may be disposed in an at least substantially aligned configuration relative to the adjacent portions of the insole body bottom surface such that the insert bottom plate 210 and the adjacent portions of the insole body bottom surface collectively define an at least substantially flat and/or continuous bottom surface of the adjustable insole. In various embodiments, the insert bottom plate 210 and the insert interface component 220 may be a singular component or, alternatively, may be defined by distinct components that are coupled to one another, as indicated in the exploded view shown in FIG. 4B.

In various embodiments, the insert bottom plate 210 may comprise an at least substantially planar component having a material thickness that is defined between a top plate surface 211 and a bottom plate surface 212. The removeable heel bottom insert 200 may be configured such that the bottom plate surface 212 of the insert bottom plate 210 may define a portion of the insole body bottom surface of the adjustable insole upon the removeable heel bottom insert 200 being inserted into the heel bottom cavity. Further, the insert bottom plate 210 may be made of the same material as at least a portion of the insole body bottom surface of the insole body, such as, for example, an open cell polyurethane material, so as to facilitate an operable engagement of the insert bottom plate 210 with an interior surface of a footwear article. In various embodiments, the insert bottom plate 210 may be defined at least in part by a bottom plate surface area that is defined by a plate width W2 and a plate length L2. As illustrated, in various embodiments, the plate length L2 of the insert bottom plate 210 may be defined by the longitudinal distance between a front longitudinal edge 210*a* and a rear longitudinal edge 210*b* of the insert bottom plate 210, as measured in a longitudinal direction defined perpendicularly therebetween (e.g., in the y-direction as defined in the exemplary orientation illustrated in FIGS. 4A and 4B). For example, in various embodiments, as a non-limiting, illustrative example, in various embodiments, the plate length L2 of the insert bottom plate 210 may be at least approximately between 35.0 mm and 55.0 mm (e.g., between 42.0 mm and 48.0 mm).

Further, in various embodiments, the plate width W2 of the insert bottom plate 210 may be defined by the lateral distance between a first lateral edge 210*c* and a second lateral edge 210*d* of the insert bottom plate 210, as measured in a lateral direction defined perpendicularly therebetween (e.g., in the x-direction as defined in the exemplary orientation illustrated in FIGS. 4A and 4B). In various embodiments, the removeable heel bottom insert 200 may be configured such that the bottom plate surface area defined by the insert bottom plate 210 may be at least substantially similar to the planar area of the cavity opening of the heel bottom cavity (e.g., the area within the cavity perimeter) such that the removeable heel bottom insert 200 is configured to at least partially fit within the heel bottom cavity of an exemplary insole body. For example, in various embodiments, as a non-limiting, illustrative example, in various embodiments, the plate width W2 of the insert bottom plate 210 may be at least approximately between 35.0 mm and 55.0 mm (e.g., between 42.0 mm and 48.0 mm).

In various embodiments, the insert interface component 220 may comprise a material component configured for contacting at least surface within a heel bottom cavity upon the removeable heel bottom insert 200 being inserted into the heel bottom cavity, so as to define the configuration of the removeable heel bottom insert 200 relative to the insole body. For example, as illustrated, the insert interface component 220 may be defined by a material thickness that extends from the insert bottom plate 210 (e.g., from a back surface 220*b* attached to a top plate surface 211 of the insert bottom plate 210) to an at least substantially non-planar insert interface surface 220*a* configured for engagement with a corresponding cavity interface component (e.g., at a cavity interface surface thereof) defined within the heel bottom cavity. As illustrated, the insert interface surface 220*a* may have an at least substantially non-planar configuration such that the insert interface component 220 is defined by a variable thickness. For example, the insert interface component 220 may be defined by one or more protruding geometric features such as, for example, a plurality of interface grooves 221, 222, 223, 224, distributed along a width of the removeable heel bottom insert 200. For example, in the exemplary embodiment illustrated in FIGS. 4A and 4B, the insert interface component 220 may comprise a plurality of interface grooves 221, 222, 223, 224 having respective lengths that extend along the plate length L2 of the insert bottom plate 210, such as, for example, in a longitudinal direction at least partially between the front and rear longitudinal sides 210*a*, 210*b* of the insert bottom plate 210.

In various embodiments, the plurality of interface grooves 221, 222, 223, 224 defined by the insert interface component 220 of the removeable heel bottom insert 200 may be arranged at least substantially adjacent to one another along the plate width W2 such that the respective lengths of each of the interface grooves 221, 222, 223, 224 extends in at least substantially parallel directions and the plurality of interface grooves collectively defines the at least substantially wave-shaped cross-sectional profile of the insert interface component 220 (e.g., the insert interface surface 220*a*). In various embodiments, the wave-shaped profile defined by the insert interface surface 220*a* may have an at least substantially uniform configuration along the length of the insert interface component 220 (e.g., along the plate length L2 of the insert bottom plate 210). Further, in various embodiments, the removeable heel bottom insert 200 may be configured to define an at least substantially symmetric configuration over a central longitudinal axis defined by the adjustable insole (as described herein in reference to FIG. 3) when the removeable heel bottom insert 200 is disposed within the heel bottom cavity of the insole body (e.g., in either a nominal position or a rotated position).

As illustrated, an exemplary insert interface component 220 may have an at least substantially wave-shaped insert interface surface 220*a* defined by the plurality of interface grooves and one or more interface channels defined in between each pair of adjacent grooves. For example, the plurality of interface grooves and interface channels may collectively embody alternating peaks and valleys that are defined along the length of the insert interface component. In various embodiments, it should be understood that although the exemplary embodiments illustrated in FIGS. 4A and 4B include a removeable heel bottom insert 200 with a insert interface surface 220*a* defined by a plurality of rounded interface grooves, the insert interface component 220 may comprise a insert interface surface 220*a* having a cross-sectional profile that is defined by one or more rounded grooves, pointed protrusions, and/or any other geometric feature suitable for engaging corresponding geometric features of a cavity interface component within the heel bottom cavity in either a nominal position or a rotated position to enable the selective arrangement of the adjustable insole in either a nominal configuration or a cushioned configuration.

In various embodiments, at least a portion of the exemplary adjustable insole 10 (e.g., the removeable heel bottom insert 200) may be made of at least substantially compliant material having a high material density and being configured to respond to one or more compression forces applied to the adjustable insole 10 by the foot of a user engaged with the insole body top surface by being reconfigured to an at least partially comprised configuration defined by a decreased insole thickness between the insole body top surface and the lowermost surface of the insole (e.g., the insole body bottom surface and/or the bottom plate surface 212 of the removeable heel bottom insert 200). In various embodiments, at least a portion of the removeable heel bottom insert 200 (e.g., the insert interface component 220) and at least a portion of the insole body 100 (e.g., the cavity interface component 120 defined within the heel bottom cavity 110) may be made of an at least partially compliant material defined by a density of at least approximately between 35 shore A and 85 shore A (e.g., between 50 shore A and 70 shore A). As a non-limiting illustrative example, in various embodiments, at least a portion of the adjustable insole (e.g., the removeable heel bottom insert 200) may be made of an open cell material, such as, for example, an open cell polyurethane material and/or the like. Further, in various embodiments, insert bottom plate 210 and insert interface component 220 may be made of either the same or different materials.

As described in further detail herein, an exemplary adjustable insole may be selectively adjustable between a nominal configuration and a cushioned configuration based at least in part on the selective arrangement of the removeable heel bottom insert 200 in one of a nominal position and a rotated position within the heel bottom cavity. For example, the exemplary adjustable insole may be selectively adjustable between a nominal configuration and a cushioned configuration based at least in part on the arrangement of the plurality of interface grooves defined by the insert interface component of the removeable heel bottom insert 200 relative to a corresponding plurality of grooves (e.g., a set of grooves having an at least substantially inverted configuration relative to those of the insert interface component 220) defined by a cavity interface component (e.g., a cavity interface surface) disposed within the heel bottom cavity. In various embodiments, the nominal configuration of an exemplary adjustable insole may be defined by the removeable heel bottom insert 200 being inserted into the heel bottom cavity of the insole body in a nominal position such that the insert interface component 220 of the removeable heel bottom insert 200 fits within a corresponding cavity interface component such that the volume of the heel bottom cavity is at least substantially filled by the removeable heel bottom insert 200, and a cushioned configuration, wherein the removeable heel bottom insert 200 is inserted into the heel bottom cavity in a rotated position such that the interface grooves defined by the insert interface surface 220*a* are arranged in a crossing configuration relative to the corresponding interface grooves defined by the cavity interface surface, thereby producing a plurality of air channels within the heel bottom cavity that at least substantially varying one or more structural support characteristics of the adjustable insole (e.g., the force absorption properties, cushioning characteristics, rebound properties, structural support capabilities, and/or the like exhibited by the adjustable insole during use).

Figure 5A:
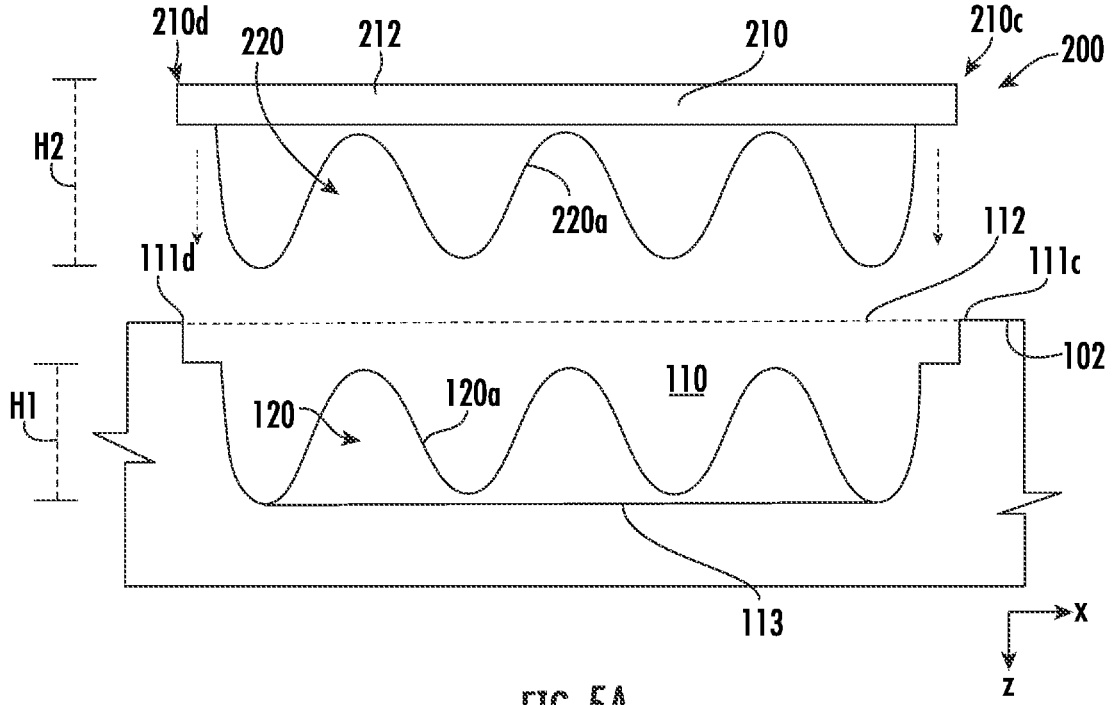
FIGS. 5A-5C illustrate various schematic views of a removeable heel bottom insert and an insole body of an exemplary adjustable insole according to various embodiments described herein.
Figure 5B:
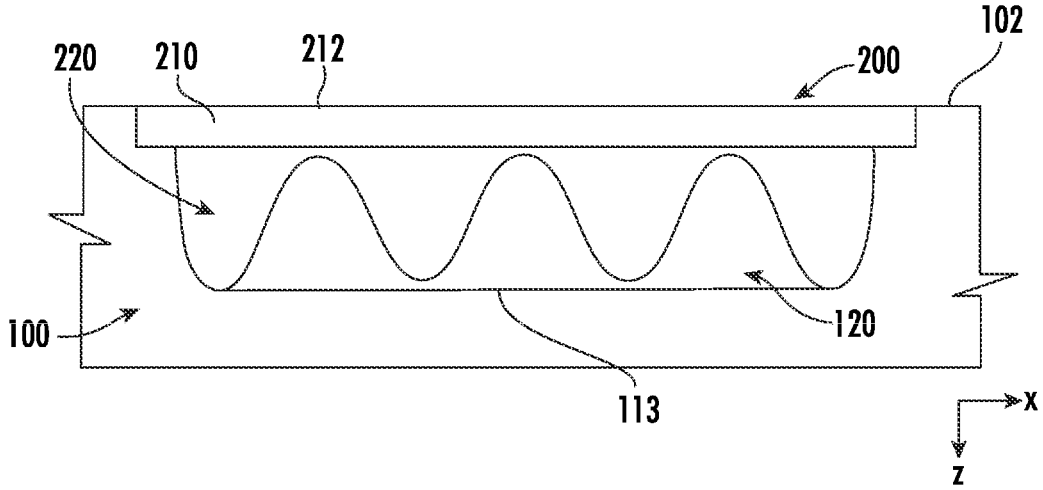
Figure 5C:
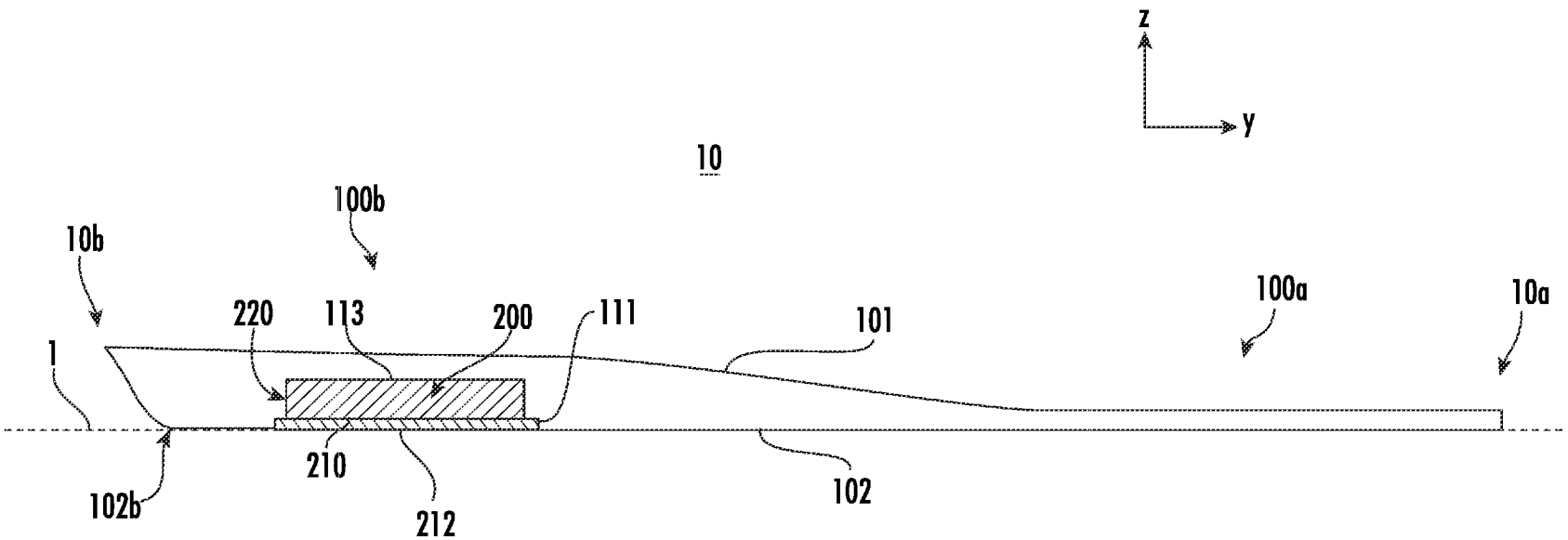

As illustrative, non-limiting examples, FIGS. 5A-5C illustrate various schematic views of a removeable heel bottom insert and an insole body of an exemplary adjustable insole according to various embodiments described herein. In particular, FIGS. 5A and 5B illustrate an exemplary removeable heel bottom insert 200 being inserted into a heel bottom cavity 110 of an exemplary insole body 100 in a nominal position, and FIG. 5C illustrates a side cross-sectional view of the exemplary adjustable insole in a nominal configuration defined by the selective arrangement of the removeable heel bottom insert 200 in the nominal position within the heel bottom cavity 110 of the insole body 100. In various embodiments, the removeable heel bottom insert 200 may have a removeable heel bottom insert height H2 that is defined by the collective of the heights of the insert bottom plate 210, defined by the plate thickness measured perpendicularly between the top plate surface 211 and the bottom plate surface 212, and the insert interface component 220. For example, the insert interface component 220 may protrude from the top plate surface 211 to the non-planar insert interface surface 220*a* such that a removeable heel bottom insert height H2 of the removeable heel bottom insert 200 is defined between the bottom plate surface 212 and one or more interface groove peaks defined at a portion of one or more of the interface grooves defined by the insert interface surface 220*a* that is furthest away from the top plate surface 211 (e.g., as measured in the positive z-direction as defined in the exemplary orientation illustrated in FIG. 5A).

In various embodiments, as illustrated, the insole body 100 of an exemplary adjustable insole may comprise a heel bottom cavity 110 defined at least in part by a cavity interface component 120 disposed therein that is configured to receive and/or be engaged by the insert interface component 220 of a removeable heel bottom insert 200 (e.g., in either a nominal position or a rotated position) to facilitate the configuration of an exemplary adjustable insole in either a nominal or a cushioned configuration.

In various embodiments, as illustrated, the cavity interface component 120 may be defined by a material thickness that extends from the recessed cavity surface 113 to an at least substantially non-planar cavity interface surface 120*a* configured for engagement with the insert interface surface 220*a* defined by the insert interface component 220 of the removeable heel bottom insert 200. As illustrated, the cavity interface surface 120*a* may have an at least substantially non-planar configuration such that the cavity interface component 120 is defined by a variable thickness. For example, in various embodiments, the cavity interface component 120 may be defined by one or more protruding geometric features such as, for example, a plurality of interface grooves having respective lengths that extend along the length of the recessed cavity surface 113, such as, for example, in a longitudinal direction defined between a front side and a rear side of the cavity perimeter 111 of the heel bottom cavity 110. Further, as illustrated, in various embodiments, the plurality of interface grooves defined by the cavity interface component 120 may be distributed along a width of the recessed cavity surface 113 (e.g., in an x-direction, as defined in the exemplary orientation illustrated in FIGS. 5A and 5B). In various embodiments, the cavity interface component 120 may protrude from the recessed cavity surface 113 to the non-planar cavity interface surface 120*a* such that a cavity interface component height H1 of the cavity interface component 120 is defined between the recessed cavity surface 113 (e.g., and/or a lowermost minimum point within a channel defined between adjacent interface grooves of the cavity interface component 120) and one or more interface groove peaks defined at a portion of one or more of the interface grooves defined by the cavity interface surface 120*a* that is furthest away from the recessed cavity surface 113 (e.g., as measured in the negative z-direction as defined in the exemplary orientation illustrated in FIG. 5A).

In various embodiments, as illustrated in FIGS. 5A and 5B, the cavity interface surface 120*a* may have a configuration that corresponds at least in part to the configuration of the insert interface surface 220*a* of the removeable heel bottom insert 200. For example, as illustrated, an exemplary cavity interface surface 120*a* may define a corresponding plurality of interface grooves having an at least substantially inverted configuration relative to the interface grooves and/or interface channels of the insert interface component 220 such that, upon the removeable heel bottom insert 200 being provided within the heel bottom cavity 110 in a nominal position (e.g., wherein the lengths of the respective interface grooves of the insert interface component 220 and the cavity interface component 120 extend in substantially the same longitudinal direction), the plurality of interface grooves defined by the insert interface component 220 may fit in an at least substantially interlocking configuration relative to the interface grooves defined by the cavity interface component 120.

In various embodiments, the removeable heel bottom insert 200 may be inserted into the heel bottom cavity 110 by moving at least a portion of the insert interface component 220 of a removeable heel bottom insert 200 through the cavity opening 112 defined within the insole body bottom surface 102 in a direction at least substantially towards the cavity interface component 120. In various embodiments, as illustrated in FIG. 5A, before and/or upon being inserted into the heel bottom cavity 110, the removeable heel bottom insert 200 may be configured in a nominal position defined by the removeable heel bottom insert 200 being arranged relative to the insole body 10 such that the lengths of the interface grooves defined by the insert interface component 220 extend in the same direction as the interface grooves of the cavity interface component 120, thereby enabling the insert interface component 220 to fit within the portion of the heel bottom cavity volume that is not occupied by the cavity interface component 120. For example, in various embodiments, the nominal position of the removeable heel bottom insert 200 may be defined by the removeable heel bottom insert 200 being positioned within the heel bottom cavity 110 such that the first and second lateral edges 210*c*, 210*d* of the insert bottom plate 210 being arranged at least substantially adjacent corresponding first and second lateral sides 111*c*, 111*d* of the cavity perimeter 111.

In various embodiments, as illustrated in FIG. 5B, an adjustable insole may be configured such that inserting the removeable heel bottom insert 200 into the heel bottom cavity 110 in the nominal position may cause at least substantially all of the cavity interface surface 120*a* to be engaged by at least substantially all of the insert interface surface 220*a* such that the removeable heel bottom insert 200 fills at least substantially the entire volume of the heel bottom cavity 110. In various embodiments, inserting the removeable heel bottom insert 200 into the heel bottom cavity 110 in the nominal position enables the corresponding configurations (e.g., the respective interface grooves and channels) of the insert interface surface 220*a* and the cavity interface surface 120*a* to fully interact in order to maximize the surface area at which the removeable heel bottom insert 200 and the cavity interface component 120 are in physical contact while minimizing the collective height defined by the two components.

As a non-limiting example of the corresponding configurations of the insert interface component 220 (e.g., the insert interface surface 220*a*) of a removeable heel bottom insert 200 and a cavity interface component 120 (e.g., the cavity interface surface 120*a*) defined within a heel bottom cavity 110, FIGS. 5A and 5B show an exemplary embodiment wherein the removeable heel bottom insert 200 comprises a insert interface component 220 with an insert interface surface 220*a* having a wave-shaped configuration defining four interface grooves distributed along the width of the insert bottom plate 210 and three interface channels defined respectively between each pair of adjacent interface grooves. Further, the exemplary embodiment illustrates the cavity interface component 120 as having a cavity interface surface 120*a* with a corresponding (e.g., inverse) wave-shaped configuration defining three similarly-configured interface grooves distributed along the width of the recessed cavity surface 113 so as to be in alignment with the three interface channels defined by the insert interface component 220 when the removeable heel bottom insert 200 is provided in a nominal position, as illustrated. Further, the cavity interface surface 120*a* may be configured to define four interface channels having an at least substantially inverted configuration relative to the four interface grooves of the insert interface component 220, including two inner interface channels defined respectively between the two adjacent pairs of interface grooves defined by the cavity interface surface 120*a* and two outer interface channels defined between an interface groove of the cavity interface component 120 and a bottom heel cavity sidewall of the heel bottom cavity 110. As illustrated, an exemplary adjustable insole may be configured such that, upon the removeable heel bottom insert 200 being arranged in a nominal position, as described herein, each of the plurality of interface grooves defined by the insert interface component of the removeable heel bottom insert 200 may be received within a corresponding interface channel defined by the cavity interface component 120 within the heel bottom cavity 110. As a non-limiting example, in various embodiments, an exemplary removeable heel bottom insert 200 may comprise an insert interface component 220 defined by a plurality of interface grooves that includes at least approximately between two grooves and fourteen grooves (e.g., between three grooves and eight grooves). In such exemplary circumstances, the insole body 100 may comprise a cavity interface component 120 defined by a cavity interface surface 120*a* having a corresponding configuration such that the surface area at which a removeable heel bottom insert 200 provided in a nominal position is in physical contact with the cavity interface surface 120*a* is at least substantially maximized.

For example, as illustrated in FIGS. 5B and 5C, the removeable heel bottom insert 200 being inserted into the heel bottom cavity 110 in the nominal position may result in at least substantially all of the removeable heel bottom insert 200 being received within the heel bottom cavity 110 of the insole body 100. In such an exemplary configuration, upon the removeable heel bottom insert 200 being inserted into the heel bottom cavity 110, the bottom plate surface 212 of the insert bottom plate 210 may be disposed in an at least substantially aligned configuration relative to one or more adjacent portions of the insole body bottom surface 102 such that the bottom plate surface 212 and the insole body bottom surface 102 collectively define an at least substantially flat and/or continuous lowermost surface of the adjustable insole. For example, in various embodiments, the removeable heel bottom insert height H2 may be at least substantially similar to the cavity depth of the heel bottom cavity 110 such that, upon the removeable heel bottom insert 200 being fully inserted into the heel bottom cavity 110 in the nominal position, as illustrated, the bottom plate surface 212 of the insert bottom plate 210 may be disposed at least substantially adjacent (e.g., within) the cavity opening 112 of the heel bottom cavity 110.

As illustrated in FIG. 5C, an exemplary adjustable insole 10 may be configured such that a removeable heel bottom insert 200 that is inserted into the heel bottom cavity 110 in a nominal position (e.g., wherein the lengths of the interface grooves defined by the insert interface component 220 extend in an at least substantially longitudinal direction, such as, for example, in a y-direction as defined in the exemplary orientation illustrated in FIG. 5C) may fit within the portion of the heel bottom cavity volume that is not occupied by the cavity interface component 120, thereby eliminating at least substantially all air pockets, air channels, and/or otherwise unoccupied volumes of air present within the heel bottom cavity 110 between the recessed cavity surface 113 and the lowermost surface 1 of the adjustable insole 10 (e.g., the portion of the lowermost surface 1 defined by the bottom plate surface 212). Such an exemplary arrangement of the removeable heel bottom insert 200 in the nominal position, as described herein, may correspond to the exemplary adjustable insole 10 being configured in a nominal configuration, as illustrated in FIG. 5C. As described herein, upon a foot of a user standing on a top body surface 101 of the insole body 100 causing one or more downward forces to be applied to the adjustable insole 10 (e.g., at least substantially towards the lowermost surface 1 of the insole 10) the structural support characteristics and/or cushioning properties defined by the exemplary adjustable insole 10 in a nominal configuration, such as, for example, the structural support characteristics and/or cushioning properties exhibited by the heel body portion 100*b* of the adjustable insole 10, may correspond at least in part by the material properties of the material(s) from which the removeable heel bottom insert 200 and the heel body portion 100*b* of the insole body 100 are made. For example, the adjustable insole 10 being in a nominal configuration, as illustrated, may correspond to one or more structural support characteristics of the adjustable insole (e.g., the force absorption properties, cushioning characteristics, rebound properties, structural support capabilities, and/or the like exhibited by the adjustable insole during use) that are at least substantially similar to those of an exemplary insole that is made as a singular material component without a removeable heel bottom insert 200, as described herein. As an illustrative example, the support and/or cushioning properties exhibited by the exemplary adjustable insole 10 provided in the nominal configuration (e.g., at the heel body portion 100*b* of the insole body 100) may represent an insole configuration defined by a reduced support and/or cushioning properties compared to an exemplary adjustable insole 10 selectively provided in a cushioned configuration, as described herein in reference to FIGS. 6A-6D.

Figure 6A:
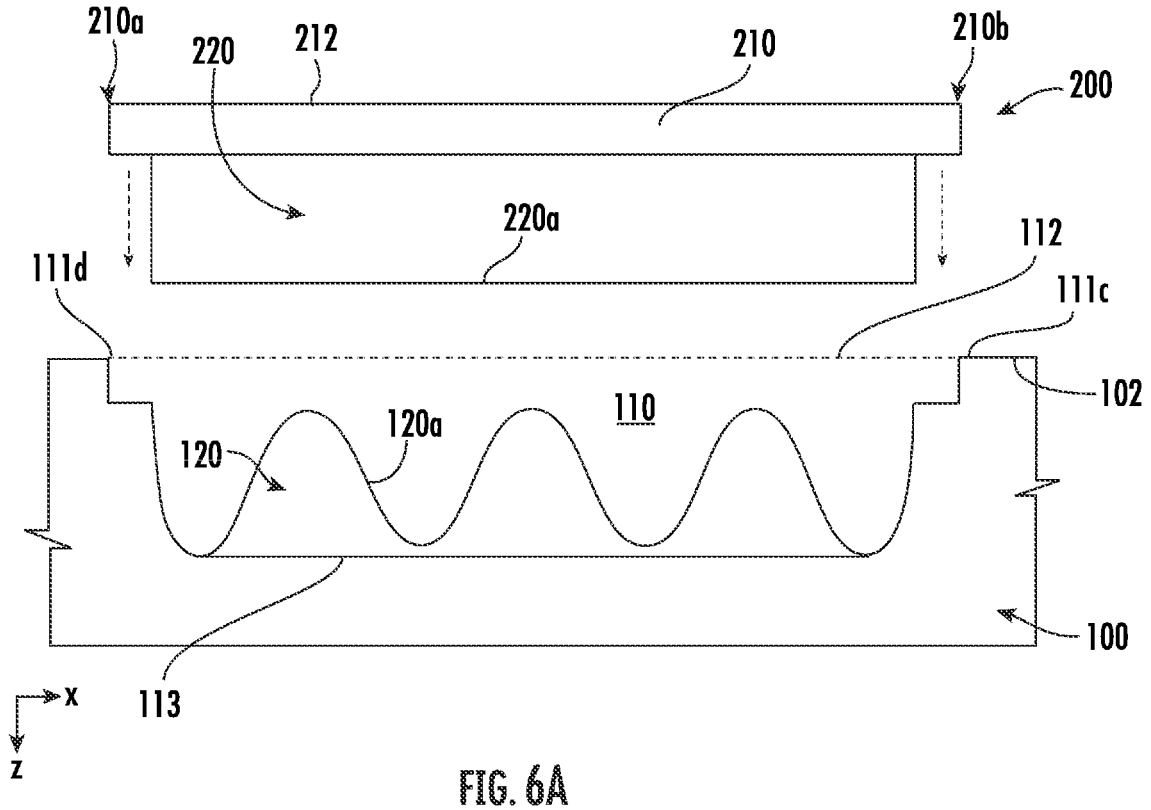
FIGS. 6A-6D illustrate various views of a removeable heel bottom insert and an insole body of an exemplary adjustable insole according to various embodiments described herein.
Figure 6B:
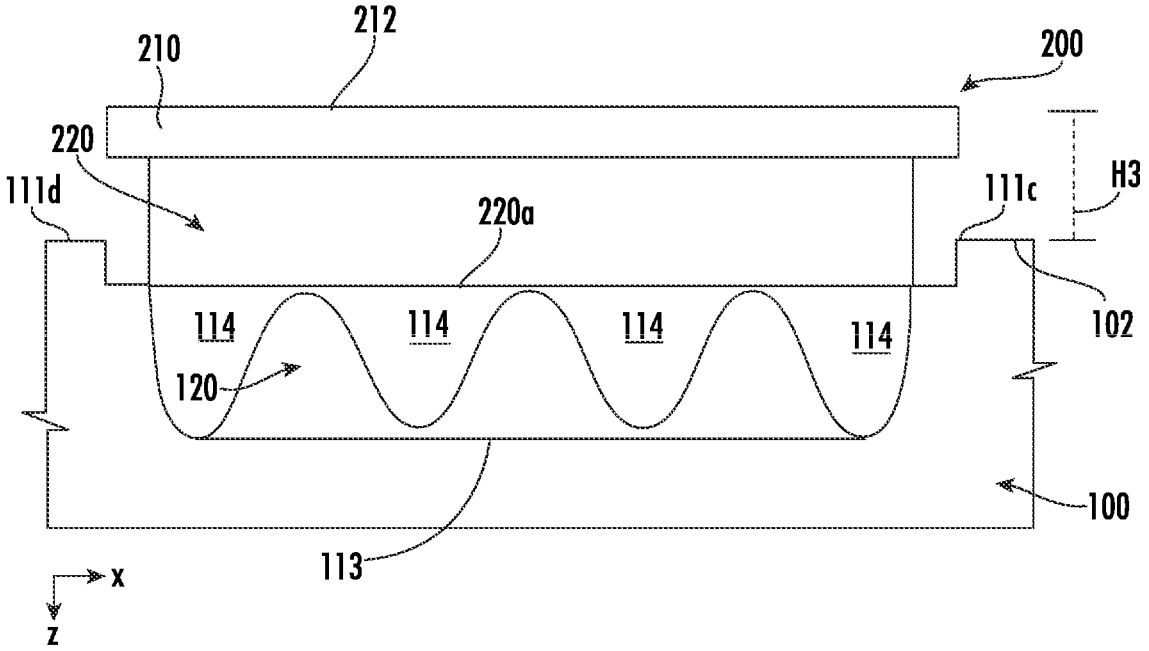
Figure 6C:
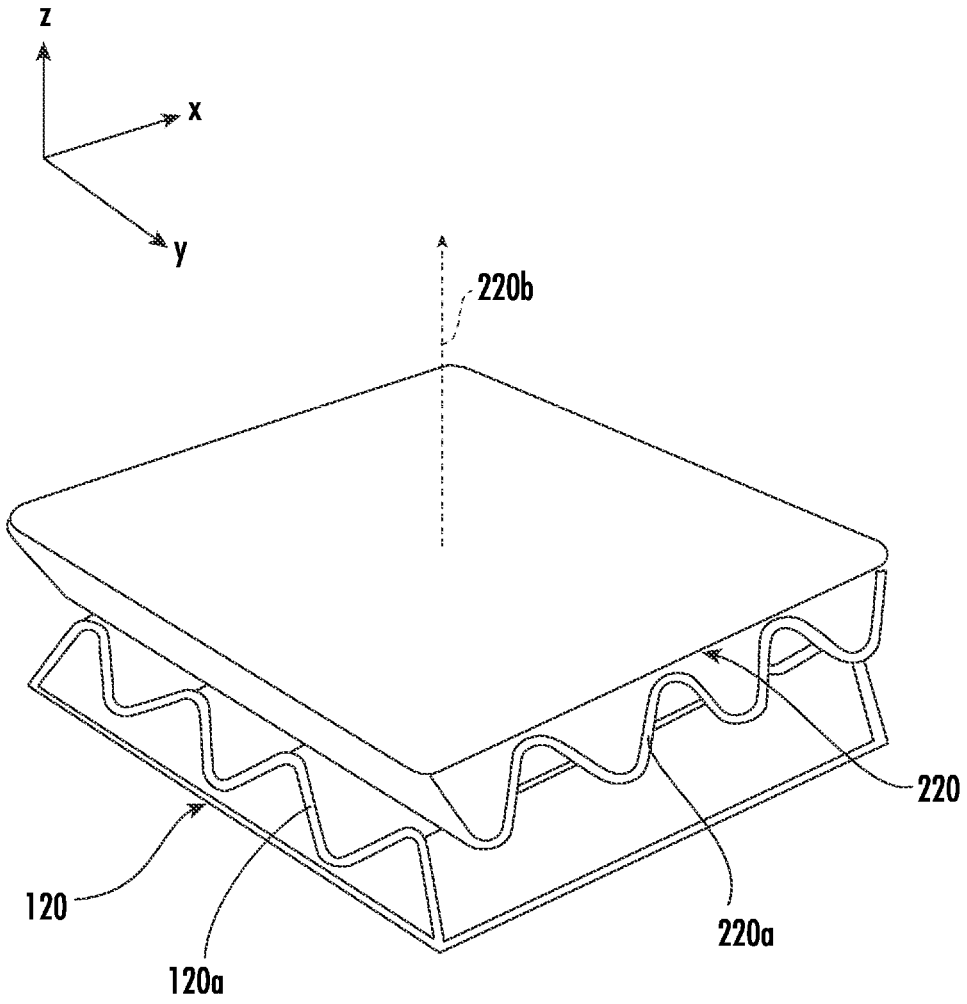
Figure 6D:
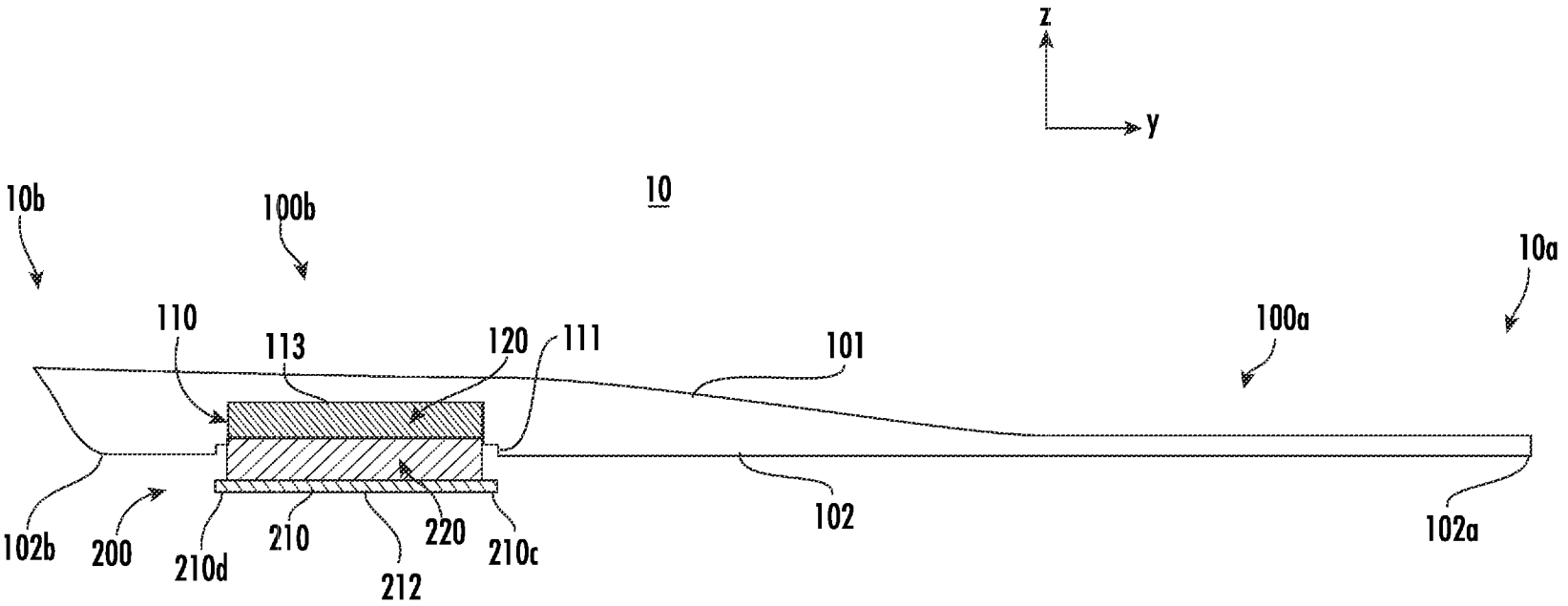

As further illustrative, non-limiting examples, FIGS. 6A-6D illustrate various views of a removeable heel bottom insert and an insole body of an exemplary adjustable insole according to various embodiments described herein. In particular, FIGS. 6A and 6B illustrate an exemplary removeable heel bottom insert 200 being inserted into a heel bottom cavity 110 of an exemplary insole body 100 in a rotated position. Further, FIG. 6C illustrates an isolated perspective view of a cavity interface component 120 engaged with an insert interface component 220 of a removeable heel bottom insert 200 that arranged in a rotated position. FIG. 6D illustrates a side cross-sectional view of the exemplary adjustable insole 10 in a cushioned configuration defined by the selective arrangement of the removeable heel bottom insert 200 in the rotated position within the heel bottom cavity 110 of the insole body 100.

In various embodiments, the removeable heel bottom insert 200 may be inserted into the heel bottom cavity 110 by moving at least a portion of the insert interface component 220 of the removeable heel bottom insert 200 through the cavity opening 112 in a direction at least substantially towards the cavity interface component 120. In various embodiments, as illustrated in FIG. 6A, before and/or upon being inserted into the heel bottom cavity 110, the removeable heel bottom insert 200 may be configured in a rotated position defined by the removeable heel bottom insert 200 being arranged relative to the insole body 10 such that the lengths of the interface grooves defined by the insert interface component 220 extend in a direction at is at least substantially transverse to the lengths of the interface grooves defined by the cavity interface component 120. For example, the removeable heel bottom insert 200 being arranged in a rotated position relative to the heel bottom cavity 110, as illustrated, may be defined by the interface grooves defined by the insert interface surface 220*a* being arranged in a crossing configuration relative to the corresponding interface grooves defined by the cavity interface surface 120*a*, wherein the lengths of the interface grooves defined by the insert interface surface 220*a* are arranged to extend in a lateral direction at least partially between a first lateral sides 111*c* and a second lateral side 111*d* of the cavity perimeter 111 (e.g., in an x-direction as defined in the exemplary orientation illustrated in FIG. 6A).

In various embodiments, as illustrated in FIG. 6B, an exemplary adjustable insole may be configured such that inserting the removeable heel bottom insert 200 into the heel bottom cavity 110 in the rotated position may cause an interface groove peak of at least a portion of the interface grooves defined by the insert interface component 220 to physically abut the cavity interface component 120 at one or more minimized areas (e.g., linear segments) defined along the cavity interface surface 120*a*. For example, in various embodiments, the rotated position of the removeable heel bottom insert 200 may be defined by at least a portion of the removeable heel bottom insert 200 being positioned within the heel bottom cavity 110 such that the first and second longitudinal edges 210*a*, 210*b* of the insert bottom plate 210 are positioned at least substantially adjacent the first and second lateral sides 111*c*, 111*d* of the cavity perimeter 111.

In various embodiments, inserting the removeable heel bottom insert 200 into the heel bottom cavity 110 in the rotated position at least substantially minimizes the surface area at which the insert interface surface 220*a* disposed within the heel bottom cavity 110 is in physical contact with the cavity interface surface 120*a*. For example, as illustrated, the lengths of each of the interface grooves defined by the insert interface component 220 are positioned laterally within the heel bottom cavity 110 such that the engagement between the insert interface surface 220*a* and the cavity interface surface 120*a* is defined by a physical contact of the interface groove peak defined by each respective interface groove of the insert interface component 220 with each of the plurality of interface grooves defined by the cavity interface surface 120*a* (e.g., at the respective interface groove peaks of each interface groove defined by the cavity interface surface 120*a*).

As a non-limiting example provided for illustrative purposes, FIG. 6C illustrates an exemplary physical engagement of a cavity interface component 120 with an insert interface component arranged in a rotated position relative thereto. As illustrated, in various embodiments, the rotated position of an exemplary removeable heel bottom insert may be defined by a rotation of the removeable heel bottom insert through an angle of rotation of at least approximately 90 degrees. For example, the rotated position of an exemplary removeable heel bottom insert may be defined relative to the nominal position of the removeable heel bottom insert by an at least substantially 90 degree turn about a central axis thereof such that a first length of an insert interface component defined by the removeable heel bottom insert is provided in an at least substantially perpendicular direction relative to a second length of a cavity interface component defined within the heel bottom cavity. The removeable heel bottom insert of an exemplary adjustable insole may be selectively rearranged from a nominal position (as described herein in reference to FIGS. 5A-5C) to the illustrated rotated position by rotating (e.g., twisting) the removeable heel bottom insert about an axis of rotation defined by a central vertical axis 220*b* of the removeable heel bottom insert (e.g., extending in an the z-direction as defined according to the exemplary orientation illustrated in FIG. 6C) through an angle of rotation of at least approximately 90 degrees such that the interface grooves defined by the insert interface component 220 are defined in a direction that is at least substantially perpendicular to the interface grooved defined by the cavity interface component 120. In various embodiments, an exemplary adjustable insole may be configured such that a removeable heel bottom insert being reconfigured in a rotated position within a heel bottom cavity of the insole body may maintain an at least substantially symmetric configuration over the central longitudinal axis defined by the insole body (as described herein in reference to FIG. 3).

In various embodiments, as illustrated in FIGS. 6B and 6D, the removeable heel bottom insert 200 being inserted into the heel bottom cavity 110 in the rotated position may result in at least a portion of the insert interface component 120 being received within the heel bottom cavity 110 of the insole body 100. For example, as illustrated, the insert interface surface 220*a* of the removeable heel bottom insert 200 provided in the rotated position may physically engage the cavity interface surface 120*a* within the heel bottom cavity 110 prior to the entirety of the removeable heel bottom insert 200 being received within the heel bottom cavity 100. Accordingly, upon the insert interface surface 220*a* physically contacting the cavity interface surface 120*a*, and prior to the adjustable insole being subjected to one or more compression forces generated by the foot of a user, the removeable heel bottom insert 200 (e.g., the insert interface component 220) may be arranged relative to the cavity interface component 120 such that a plurality of air channels 114 may be defined within the heel bottom cavity 110 in between the cavity interface surface 120*a* (e.g., and/or the recessed cavity surface 113) and the removeable heel bottom insert 200.

Further, in such an exemplary configuration, upon the insert interface surface 220*a* physically contacting the cavity interface surface 120*a*, and prior to the adjustable insole being subjected to one or more compression forces generated by the foot of a user, the bottom plate surface 212 of the insert bottom plate 210 may be disposed in an at least substantially raised configuration relative to one or more adjacent portions of the insole body bottom surface 102. Such an exemplary arrangement of the removeable heel bottom insert 200 in the rotated position within the heel bottom cavity 110 may maximize the collective height defined by the removeable heel bottom insert 200 and the cavity interface component 120 such that, up the exemplary insole 10 being positioned within an interior portion of a footwear article, at least a portion of the insole body top surface 101 defined within the heel body portion 100*b* of the insole body 100 may be raised relative to an interior surface of the footwear article that is engaged with the lowermost surface of the insole 10. For example, in such an exemplary circumstance, a first portion of the removeable heel bottom insert 200 including the insert interface surface 220*a* may be disposed within the heel bottom cavity 110, while a second portion of the removeable heel bottom insert 200 including the insert bottom plate 210 (e.g. the bottom plate surface 212) may be disposed outside of the heel bottom cavity 110 (e.g., beyond the cavity opening 112) such that the bottom plate surface 212 is disposed in a raised position relative to the adjacent portions of the insole body bottom surface 102 (e.g., the cavity perimeter 111). As illustrated, the raised position of the bottom plate surface 212 of the removeable heel bottom insert 200 may be defined by a vertical separation distance H3 between an adjacent portion of the insole body bottom surface 102 (e.g., the cavity perimeter 111) and the bottom plate surface 212 of the insert bottom plate 210 of the removeable heel bottom insert 200, as measured in a direction defined perpendicularly therebetween (e.g., in a z-direction, as defined according to the exemplary orientation illustrated in FIG. 6B). In various embodiments, the exemplary adjustable insole may be configured such that a vertical separation distance H3 between an insole body bottom surface 102 (e.g., the cavity perimeter 111) and a bottom plate surface 212 of a removeable heel bottom insert 200 engaged with the cavity interface surface 120*a* in a rotated position may be at least approximately between 5.0 mm and 30.0 mm (e.g., between 10.0 mm and 20.0 mm).

As illustrated in FIG. 6D, an exemplary adjustable insole 10 may be configured such that a removeable heel bottom insert 200 that is disposed at least partially within the heel bottom cavity 110 in a rotated position (e.g., wherein the lengths of the interface grooves defined by the insert interface component 220 extend in an at least substantially lateral direction transverse to the lengths of the interface grooves defined by the cavity interface component 120, such as, for example, in a direction perpendicular to the y-direction as defined in the exemplary orientation illustrated in FIG. 6D) may define a non-continuous engagement of the cavity interface component 120 at one or more distinct points and/or lines defined along the cavity interface surface 120*a*, thereby defining a plurality of air pockets, air channels, and/or otherwise unoccupied volumes of air present within the heel bottom cavity 110 between the cavity interface component 120 (e.g., and/or the recessed cavity surface 113) and the removeable heel bottom insert 200. Such an exemplary arrangement of the removeable heel bottom insert 200 in the rotated position, as described herein, may correspond to the exemplary adjustable insole 10 being configured in a cushioned configuration, as illustrated in FIG. 6D. As described herein, as one or more compression forces acting on the heel body portion 100*b* of the adjustable insole 10 (e.g., from the foot of a user) cause the cavity interface component 120 and the insert interface component 220 of the removeable heel bottom insert 200 to be collectively reconfigured in an at least partially compressed configuration, the plurality of air pockets, air channels, and/or otherwise unoccupied volumes of air present within the heel bottom cavity 110 (e.g., in the between the cavity interface component 120 and the removeable heel bottom insert 200) as a result of the arrangement of the removeable heel bottom insert 200 in the rotated position may correspond to an at least partial increase in the structural support characteristics and/or cushioning properties defined by the adjustable insole 10 (e.g., at the heel body portion 100*b*). For example, the adjustable insole 10 being in a cushioned configuration, as illustrated, may correspond to one or more structural (e.g., support) properties and/or cushioning properties that are at least substantially increased relative to those of an exemplary insole that is made as a singular material component without a removeable heel bottom insert 200. Further, in various embodiments, the increased collective height defined by the cavity interface component 120 and the removeable heel bottom insert 200 provided in the rotated position may correspond to an increase in one or more structural support characteristics defined by the heel body portion 100*b*, as the insole 10 is configured to withstand increased compression forces over an increased compression distance while maintaining a desirably cushioned and/or structured configuration. As an illustrative example, the support and/or cushioning properties exhibited by the exemplary adjustable insole 10 provided in the nominal configuration (e.g., at the heel body portion 100*b* of the insole body 100) may represent an insole configuration defined by an increased support and/or cushioning properties compared to an exemplary adjustable insole 10 selectively provided in a nominal configuration, as described herein in reference to FIGS. 5A-5C.

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An adjustable insole for a footwear article, the adjustable insole comprising:

an insole body configured to be removably inserted into a footwear article, the insole body comprising a heel bottom cavity defined by a cavity opening provided along an insole body bottom surface of the insole body, the heel bottom cavity being defined within a heel body portion of the insole body; and a removeable heel bottom insert configured to be at least partially disposed within the heel bottom cavity such that a first insert portion is disposed within the heel bottom cavity and a second insert portion defines at least a portion of a lowermost surface of the adjustable insole, the removeable heel bottom insert having a selectively adjustable configuration relative to the insole body that is defined by an arrangement of the removeable heel bottom insert within the heel bottom cavity in one of a nominal position and a rotated position, wherein the removeable heel bottom insert comprises an insert bottom plate and an insert interface component configured to engage one or more surfaces defined within the heel bottom cavity, the first insert portion of the removeable heel bottom insert being defined by the insert interface component and the second insert portion of the removeable heel bottom insert being defined by the insert bottom plate;

wherein the rotated position of the removeable heel bottom insert within the heel bottom cavity is defined relative to the nominal position by a rotation of the removeable heel bottom insert within the heel bottom cavity through an angle of rotation of at least approximately 90 degrees; and wherein the arrangement of the removeable heel bottom insert within the heel bottom cavity in one of the nominal position and the rotated position corresponds to a selective adjustment of the adjustable insole between a nominal configuration and a cushioned configuration, the selective adjustment of the adjustable insole between the nominal configuration and the cushioned configuration defining an adjustment of one or more structural support characteristics defined by the adjustable insole.

2. The adjustable insole of claim 1, wherein the second insert portion is defined by a bottom plate surface of the insert bottom plate, the bottom plate surface being configured for contacting an interior surface of the footwear article, and wherein the insert interface component is configured to extend from a top plate surface of the insert bottom plate, the top plate surface facing in an at least substantially opposite direction relative to the bottom plate surface.

3. The adjustable insole of claim 1, wherein the insert interface component comprises a variable thickness defined between the insert bottom plate and an insert interface surface, the insert interface component being configured to engage the one or more surfaces within the heel bottom cavity at the insert interface surface.

4. The adjustable insole of claim 3, wherein the insert interface surface is defined by an at least substantially non-planar surface, the insert interface component being defined by one or more geometric features protruding from the insert bottom plate to the insert interface surface such that the one or more geometric features of the insert interface component are configured to engage the one or more surfaces within the heel bottom cavity at the at least substantially non-planar surface.

5. The adjustable insole of claim 4, wherein the insole body comprises a cavity interface component defined with the heel bottom cavity, the cavity interface component being configured for contact with at least a portion of the insert interface surface contact to at least partially define the arrangement of the insert interface component within the heel bottom cavity, the one or more surfaces within the heel bottom cavity configured to be engaged by the insert interface component being defined by the cavity interface component.

6. The adjustable insole of claim 4, wherein the insert interface surface comprises an at least partially wave-shaped configuration, and wherein the one or more geometric features comprises a plurality of interface grooves distributed laterally along a width of the removeable heel bottom insert, each of the plurality of interface grooves extending along a respective groove length defined between opposing longitudinal ends of the removeable heel bottom insert.

7. The adjustable insole of claim 4, wherein the removeable heel bottom insert is configured such that, upon the removeable heel bottom insert being at least partially disposed within the heel bottom cavity, the one or more geometric features defining the insert interface component comprises a symmetric configuration over a central longitudinal axis defined by the insole body.

8. The adjustable insole of claim 3, wherein the insert interface component is configured to engage a cavity interface component disposed within the heel bottom cavity, the cavity interface component comprising a cavity interface surface configured to physically contact the insert interface surface, wherein the cavity interface surface is defined by a configuration that corresponds at least in part to the configuration of the insert interface surface.

9. The adjustable insole of claim 1, wherein the removeable heel bottom insert is defined at least in part by an insert interface surface having a first surface configuration, the first surface configuration corresponding at least in part to a second surface configuration of a cavity interface surface defined within the heel bottom cavity.

10. The adjustable insole of claim 9, wherein the nominal position of the removeable heel bottom insert is defined by at least substantially all of the removeable heel bottom insert being disposed within the heel bottom cavity such that at least substantially all of a cavity volume defined within the heel bottom cavity is occupied by one of the removeable heel bottom insert and a cavity interface component engaged therewith.

11. The adjustable insole of claim 10, wherein the nominal position is defined by the second portion of the removeable heel bottom insert being defined by a bottom plate surface of an insert bottom plate of the removeable heel bottom insert, the bottom plate surface being arranged in an at least substantially aligned configuration relative to one or more adjacent portions of the insole body bottom surface.

12. The adjustable insole of claim 1, wherein the heel bottom cavity is arranged within the heel body portion such that a first lateral side of a cavity perimeter of the heel bottom cavity is separated from an inner lateral side of the insole body bottom surface by a first lateral separation gap defined along the insole body bottom surface; wherein a second lateral side of the cavity perimeter of the heel bottom cavity is separated from an outer lateral side of the insole body bottom surface by a second lateral separation gap defined along the insole body bottom surface.

13. The adjustable insole of claim 12, wherein the heel bottom cavity is arranged within the heel body portion such that a rear side of the cavity perimeter of the heel bottom cavity is separated from a rear portion of the insole body bottom surface by a first longitudinal separation gap defined along the insole body bottom surface.

14. The adjustable insole of claim 1, wherein the heel bottom cavity is centered along a central longitudinal axis of the insole body, wherein a cavity interface component disposed within the heel bottom cavity and defined by one or more geometric features configured to engage the removeable heel bottom insert, and wherein the cavity interface component is configured such that the one or more geometric features defines an at least substantially symmetric configuration over the central longitudinal axis.

15. The adjustable insole of claim 1, wherein the selective adjustment of the adjustable insole between the nominal configuration and the cushioned configuration corresponds to an adjustment of one or more structural support characteristics defined within the heel body portion of the insole body.

16. The adjustable insole of claim 1, wherein the rotated position of an exemplary removeable heel bottom insert is defined relative to the nominal position of the removeable heel bottom insert by an at least substantially 90 degree turn about a central axis thereof such that a first length of an insert interface component defined by the removeable heel bottom insert is provided in an at least substantially perpendicular direction relative to a second length of a cavity interface component defined within the heel bottom cavity.

17. The adjustable insole of claim 1, wherein the removeable heel bottom insert comprises an insert interface component defined by one or more insert interface grooves, wherein the heel bottom cavity includes a cavity interface component disposed therein that is defined by a plurality of cavity interface grooves, the plurality of insert interface grooves being configured to physically contact at least a portion of the plurality of cavity interface grooves upon the removeable heel bottom insert being disposed within the heel bottom cavity, and wherein the rotated position of the removeable heel bottom insert is defined by the removeable heel bottom insert being positioned within the heel bottom cavity such that the plurality of insert interface grooves extend along respective lengths that are defined in a first direction that is at least substantially transverse to a second direction in which lengths of each of the cavity interface grooves of the cavity interface component extend.

18. The adjustable insole of claim 1, wherein the rotated position of the removeable heel bottom insert is defined the removeable heel bottom insert and a cavity interface component engaged therewith within the heel bottom cavity collectively defining an increased collective height such that the heel body portion defines an at least partially raised configuration relative to a second configuration wherein the removeable heel bottom insert is in the nominal position.

19. The adjustable insole of claim 1, wherein the rotated position of the removeable heel bottom insert is defined by an insert interface component of the removeable heel bottom insert engaging at least a portion of a cavity interface component disposed within the heel bottom cavity such that at least one air channels defined by unoccupied cavity volume within the heel bottom cavity are defined between the removeable heel bottom insert and the cavity interface component.

* * * * *